US007717586B2

(12) United States Patent
Tucker

(10) Patent No.: US 7,717,586 B2
(45) Date of Patent: May 18, 2010

(54) FOLDABLE LIGHT

(75) Inventor: Mark Tucker, Deposit, NY (US)

(73) Assignee: E-Z Red Company, Deposit, NY (US)

( * ) Notice: Subject to any disclaimer, the term of this patent is extended or adjusted under 35 U.S.C. 154(b) by 243 days.

(21) Appl. No.: 12/007,504

(22) Filed: Jan. 11, 2008

(65) Prior Publication Data

US 2008/0174991 A1 Jul. 24, 2008

Related U.S. Application Data

(60) Provisional application No. 60/880,956, filed on Jan. 18, 2007.

(51) Int. Cl.
*F21S 4/00* (2006.01)
*F21V 21/00* (2006.01)

(52) U.S. Cl. ..... 362/249.05; 362/249.01; 362/249.02; 362/249.06; 362/249.07; 362/249.09; 362/249.1; 362/249.11; 362/249.12; 362/394; 362/398; 362/418; 362/427

(58) Field of Classification Search ..... 362/249.01–249.14, 394, 398, 418, 427
See application file for complete search history.

(56) References Cited

U.S. PATENT DOCUMENTS

| | | | | |
|---|---|---|---|---|
| 5,653,529 | A | 8/1997 | Spocharski | |
| 5,685,631 | A | 11/1997 | Dobert et al. | |
| 6,461,008 | B1 | 10/2002 | Pederson | |
| 6,476,726 | B1 | 11/2002 | Pederson | |
| 6,623,151 | B2 | 9/2003 | Pederson | |
| 6,707,389 | B2 | 3/2004 | Pederson | |
| 6,814,459 | B2 | 11/2004 | Pederson | |
| 6,830,360 | B1 | 12/2004 | Galvez | |
| 6,857,756 | B2 | 2/2005 | Reiff et al. | |
| 6,879,263 | B2 | 4/2005 | Pederson et al. | |
| 6,939,021 | B2 | 9/2005 | Leslie et al. | |
| 6,979,100 | B2 | 12/2005 | Reiff et al. | |
| 7,306,348 | B2 * | 12/2007 | Quittner | 362/103 |
| 7,513,662 | B2 * | 4/2009 | Parker et al. | 362/396 |
| 2002/0071268 | A1 | 6/2002 | Pederson | |
| 2003/0179572 | A1 | 9/2003 | Schnell | |
| 2004/0222947 | A1 | 11/2004 | Newton et al. | |
| 2005/0018435 | A1 | 1/2005 | Selkee et al. | |
| 2005/0047167 | A1 | 3/2005 | Pederson et al. | |
| 2005/0057941 | A1 | 3/2005 | Pederson et al. | |
| 2005/0063179 | A1 | 3/2005 | Niemann | |
| 2005/0099317 | A1 | 5/2005 | Pederson et al. | |
| 2005/0225968 | A1 * | 10/2005 | Hatherill et al. | 362/157 |
| 2005/0231381 | A1 | 10/2005 | Pederson et al. | |
| 2005/0265035 | A1 | 12/2005 | Brass et al. | |
| 2005/0276045 | A1 | 12/2005 | Kovacik et al. | |
| 2006/0034070 | A1 * | 2/2006 | Kovacik et al. | 362/157 |
| 2006/0034078 | A1 | 2/2006 | Kovacik et al. | |
| 2006/0034091 | A1 | 2/2006 | Kovacik et al. | |
| 2006/0238968 | A1 * | 10/2006 | Maatta et al. | 361/683 |
| 2008/0125195 | A1 * | 5/2008 | Maenpaa | 361/679 |

* cited by examiner

*Primary Examiner*—Sandra L O'Shea
*Assistant Examiner*—William J Carter
(74) *Attorney, Agent, or Firm*—Breiner & Breiner, LLC

(57) ABSTRACT

A foldable, rechargeable light emitting diode (LED) pocket light is disclosed. The light includes a first compartment, a second compartment and a hinge element. The first compartment has a housing, a plurality of LED lights, a rotatable hinge, and a hook for hanging the light. The second compartment includes a housing, a member for receiving the rotatable hinge and a power source. The light also includes an activating member and circuitry for activating the LED lights.

8 Claims, 4 Drawing Sheets

FOLDABLE LIGHT

RELATED APPLICATIONS

This application claims benefit of U.S. provisional application Ser. No. 60/880,956, filed Jan. 18, 2007, entitled FOLDABLE LIGHT.

FIELD OF INVENTION

The present invention relates to a foldable light. More particularly, the invention relates to a foldable, rechargeable light emitting diode (LED) pocket light.

BACKGROUND OF INVENTION

This invention relates to foldable, rechargeable pocket lights. More specifically, the invention relates to foldable, rechargeable LED pocket lights. Pocket lights are useful in multiple settings including business, pleasure and at home. More particularly, pocket lights are useful in the mechanical and automotive industry for providing light in tight spaces since they are able to be positioned in tight spaces. LED pocket lights are useful because of the brightness of the light provided. Rechargeable LED pocket lights are further useful for longevity of use.

Foldable, rechargeable pocket lights are known. However, some problems with such devices include that they are larger in size and shape, do not fold and are difficult to use. It would be useful to have a compact, foldable, rechargeable LED pocket light to avoid the problems of the prior art. This includes a pocket light which is portable, easy to stow on one's belt or pouch and able to direct light at any desired position.

One such known pocket light is the Energizer® folding LED pocket light. This pocket light runs on one LED bulb or two LED bulbs. Additional LED lights are disclosed in the following U.S. patents and U.S. patent application Publications: U.S. Pat. Nos. 6,979,100; 6,939,021 B2; 6,879,263; 6,857,756; 6,830,360 B1; 6,814,459 B2; 6,707,389; 6,623,151 B2; 6,476,726 B1; 6,461,008 B1; 5,685,631, and 5,653,529, and U.S. Patent Application Publication Nos. 2006/0034091 A1; 2006/0034078 A1; 2006/0034070 A1; 2005/0276045 A1; 2005/0265035 A1; 2005/0231381 A1; 2005/0099317 A1; 2005/0063179 A1; 2005/0057941 A1; 2005/0047167 A1; 2005/0018435 A1; 2004/0222947 A1; 2003/0179572 A1, and 2002/0071268 A1.

These devices have various shortcomings, which along with other shortcomings, are addressed by the present invention.

OBJECTS AND SUMMARY OF INVENTION

The invention relates to a foldable light which is preferably a foldable LED light which may be rechargeable. The LED pocket light includes a first compartment, a second compartment and a hinge element. The first compartment has a plurality of LED lights and has a rotatable hinge for opening and closing the light. The first compartment further has a hook member for hanging the light device in an environment of use. The second compartment includes a means for receiving the rotatable hinge for opening and closing the device. The second compartment of the foldable pocket light mates with the first compartment at the hinge to open and close the light, i.e., fold the light.

A primary object of the present invention is to provide a foldable, rechargeable LED pocket light which is compact, easy to open and use and directs light in any of a number of directions.

Another primary object of the invention is to provide a foldable, rechargeable LED pocket light which includes a means for attaching the device to a person.

Another primary object of the present invention is to provide a foldable, rechargeable LED pocket light which includes a hook means for attaching the light to an object to free the user's hands when used in a work environment.

Another primary object of the present invention is to provide a foldable, rechargeable LED pocket light which provides greater brightness than the prior art pocket lights and is more compact and easier to store and carry than the prior art pocket lights.

These primary and other objects of the invention will be apparent from the following description of the preferred embodiments of the invention and from the accompanying drawings.

BRIEF DESCRIPTION OF THE DRAWINGS

Referring to the drawings.

DETAILED DESCRIPTION OF THE PREFERRED EMBODIMENTS

Figure 1:
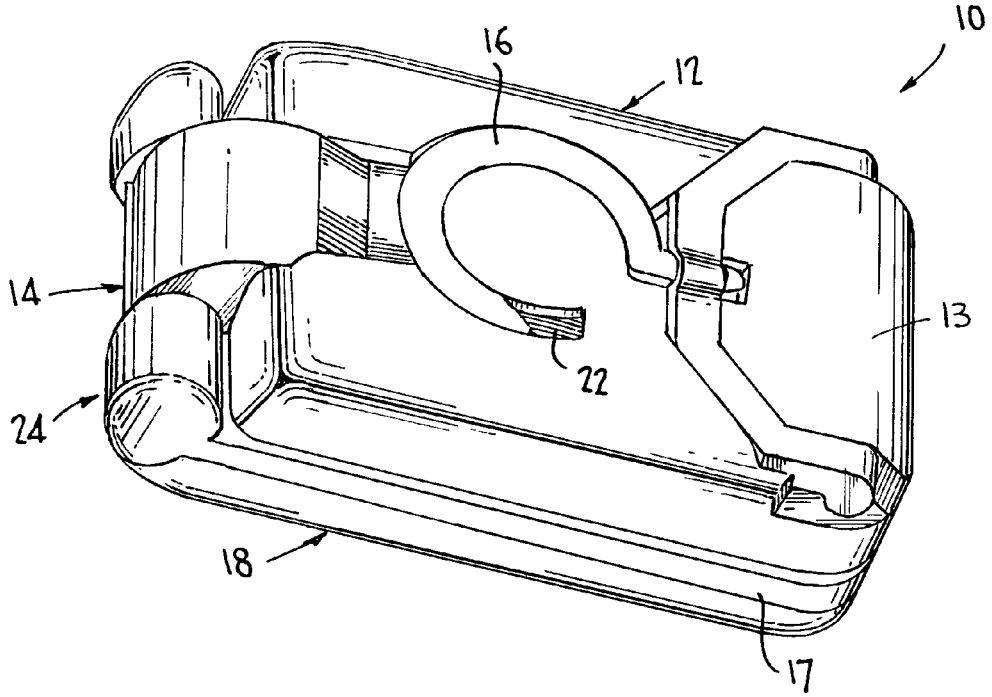
FIG. 1 is a top perspective view of an embodiment of the pocket light of the present invention in a closed position.
Figure 2:
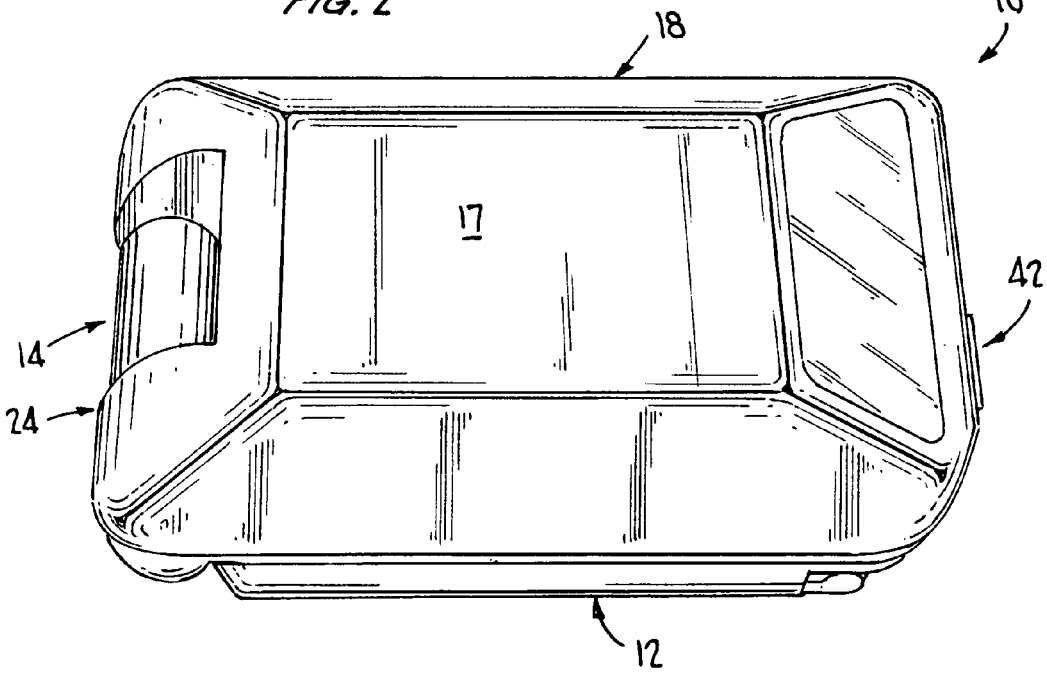
FIG. 2 is a bottom perspective view of an embodiment of the pocket light of the present invention in a closed position.
Figure 3:
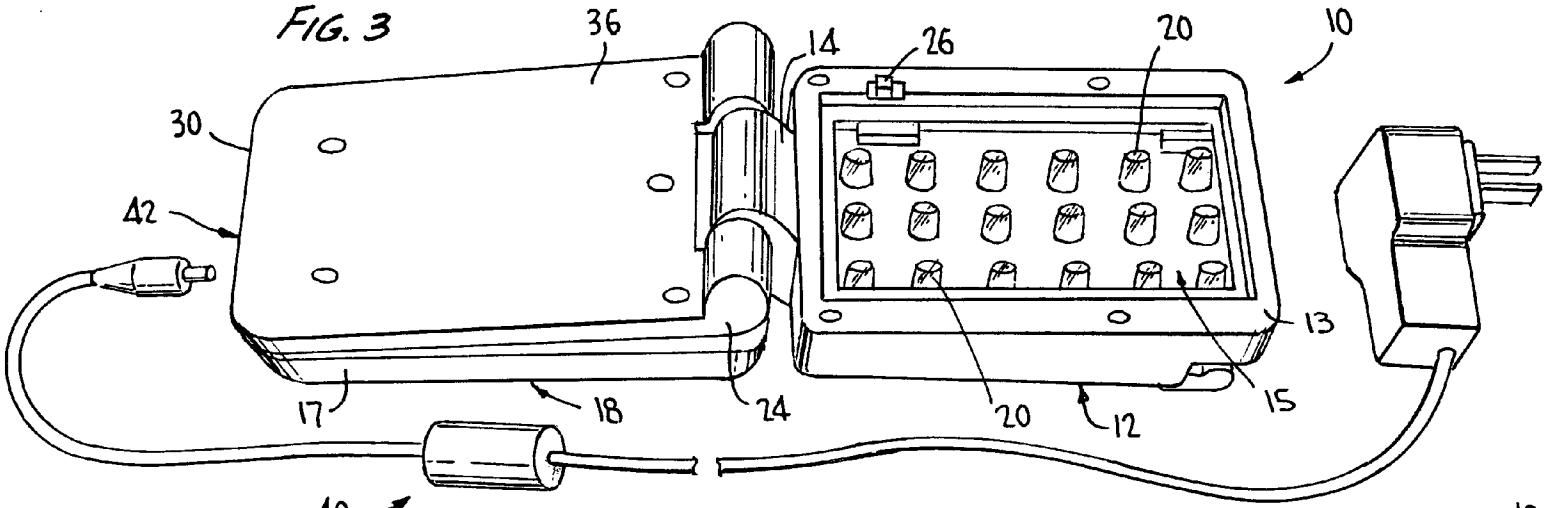
FIG. 3 is an inside perspective view of an embodiment of the pocket light of the present invention in an open position.
Figure 4:
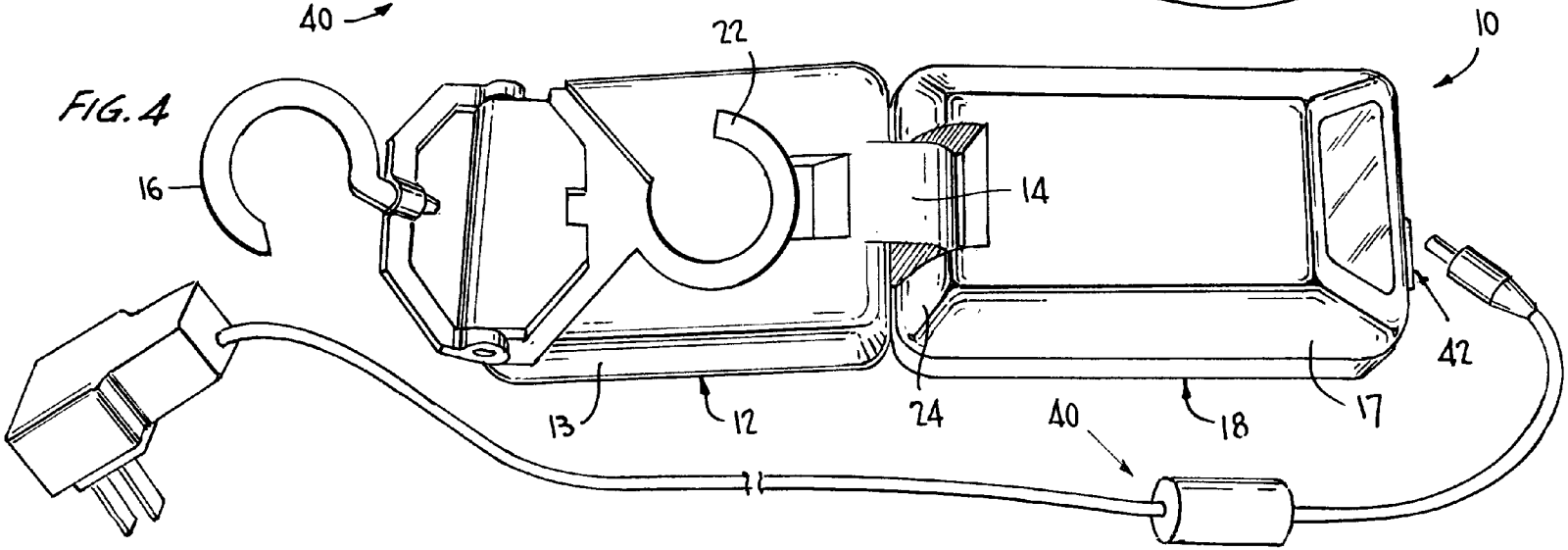
FIG. 4 is an outside perspective view of an embodiment of the pocket light of the present invention in an open position.
Figure 5:
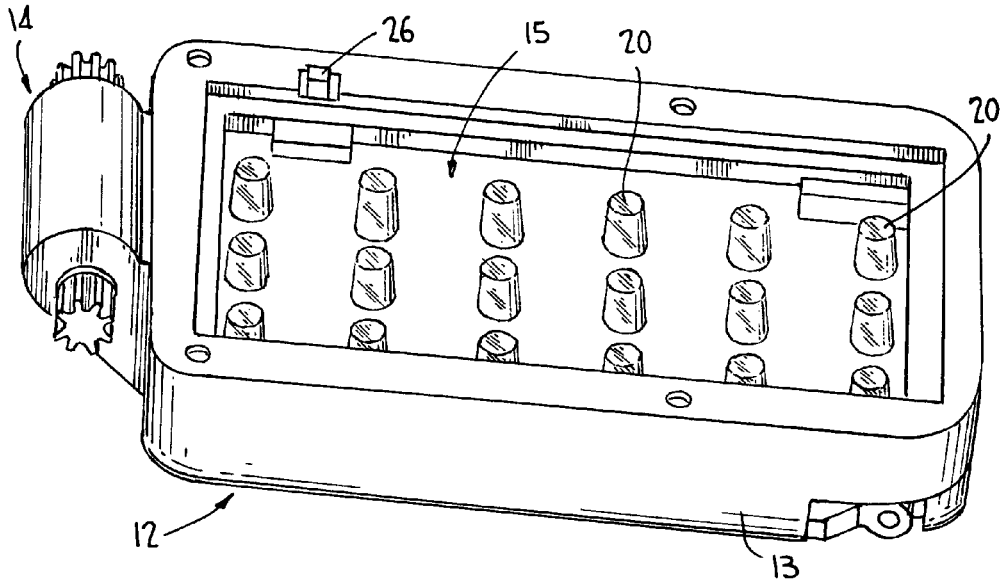
FIG. 5 is a perspective view of a first compartment of the pocket light of the present invention.
Figure 6:
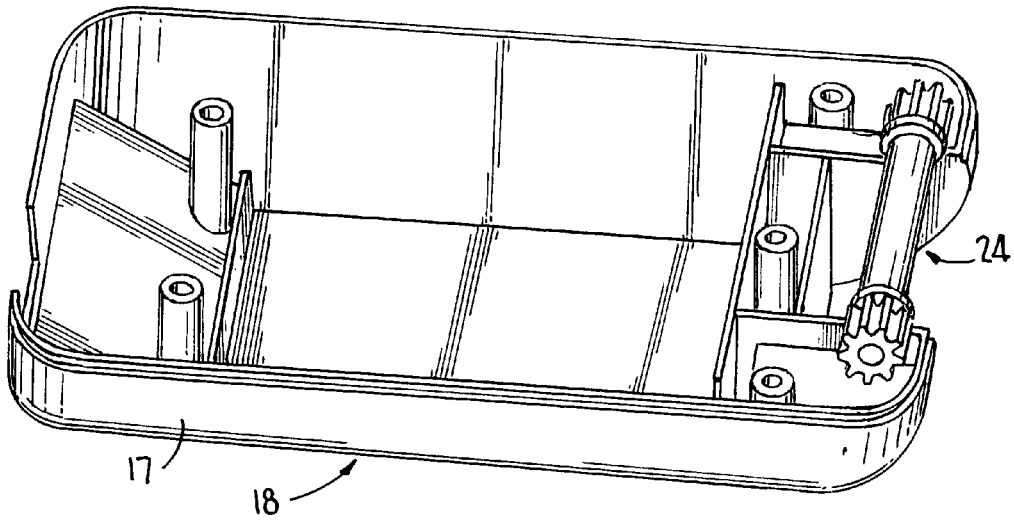
FIG. 6 is a perspective view of a second compartment of the pocket light of the present invention.
Figure 7:
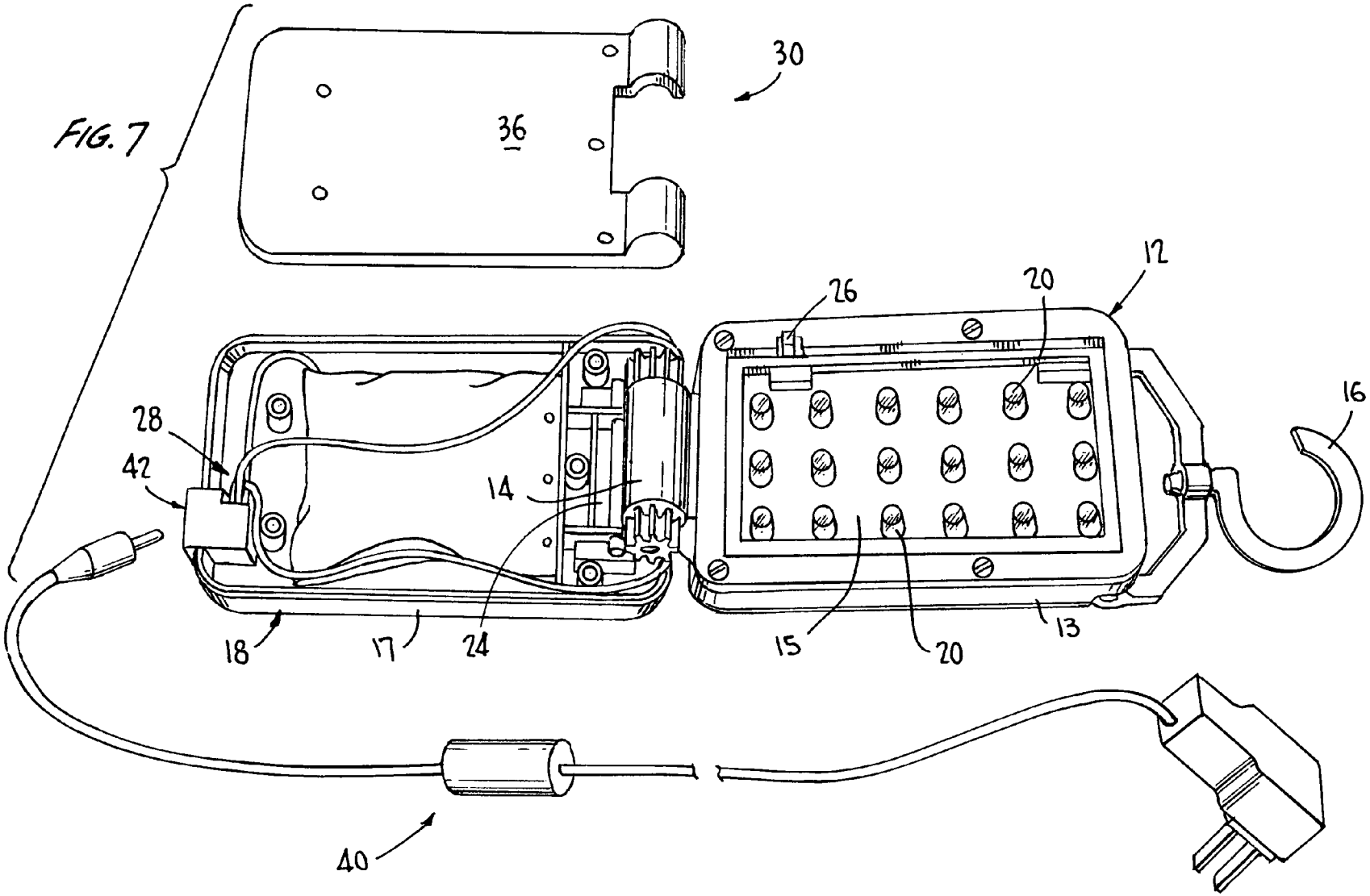
FIG. 7 is an exploded view of the pocket light of the present invention in an open position.

Referring to FIGS. 1-7, the foldable, rechargeable LED pocket light 10 of the invention is foldable on a hinge which opens and closes the light 10. The light 10 includes a first compartment 12 and a second compartment 18. The first compartment 12 has a housing 13 with a plurality of LED lights 20 in a preferred embodiment. The first compartment 12 includes a rotatable hinge 14 for opening and closing the pocket light 10. The first compartment 12 further contains a hook member 16 for hanging the device in an environment of use. The first compartment 12 also includes a recess portion 22 for receiving the hook member 16 when the hook member 16 is not in use. The hook member 16 and recess portion 22 may be operatively positioned in any suitable location on the first compartment. However, the hook member 16 and recess portion 22 may be operatively positioned in any suitable location on the second compartment.

The plurality of LED lights 20 may be operatively positioned in any suitable arrangement in the first compartment 12. In a preferred embodiment, the plurality of LED lights 20 are arranged in a plurality of rows and columns, such as shown for example in FIGS. 3, 5 and 7. The plurality of LED lights 20 are operatively positioned within an internal recess 15 within the housing 13 of the first compartment 12.

The second compartment 18 of the foldable pocket light 10 mates with the first compartment 12. The second compartment 18 includes a housing 17 and a means 24 for receiving the rotatable hinge 14 for opening and closing the device. In another preferred embodiment, the second compartment 18 may include a rotatable hinge and the first compartment 12 may include a means for receiving the rotatable hinge. In another embodiment, the first compartment 12 and the second compartment 18 may be joined by any suitable connecting member.

The second compartment 18 further includes a means for holding a power supply, which may be any suitable power supply. In a preferred embodiment, the power supply is three nickel metal Hydride (NiMh) AA batteries, providing eighteen hundred mille amp hour at 3.6 volts.

The first compartment 12 and/or the second compartment 18 includes an activating member 26,36 for opening and closing the circuit 28 for activating the plurality of LED lights 20. When the device is closed, the circuit 28 is opened and the plurality of LED lights 20 are turned off. When the device is opened, the circuit is closed and illumination is provided by the plurality of LED lights 20.

The activating member 26,36 for opening and closing the circuit 28 and turning the lights 20 on and off may be any suitable means. For example, in a preferred embodiment, the activating member 26 is an arm extending from an inner surface of the first compartment 12. When the arm is pressed in, the circuit is open and the plurality of LED lights 20 are turned off. When the arm is released, the circuit is closed and the plurality of LED lights 20 are turned on. The activating member 36 on the second compartment 18 may be any suitable means but is preferably a surface of the second compartment 18 such as shown for example in FIGS. 3 and 7.

In a preferred embodiment, the second compartment 18 includes a housing 17 having a cover portion 30 which encloses the circuitry of the device. The cover portion 30 is held in place by a fastening means, which may be any suitable fastening means. The circuitry may be any suitable circuitry.

Accordingly, the present invention provides for a small, handheld, rechargeable LED pocket light which may function as a work light, for example, when working on automobiles. When the light 10 is opened, the plurality of LED lights 20 turn on and when closed, the plurality of LED lights 20 turn off via the activating member 26 on the first compartment 12 and the activating member 36 on the second compartment 18.

In a preferred embodiment, the light 10 has up to a predetermined time, e.g., seven hours of time, between charges and may be recharged in a predetermined time, e.g., three to four hours, using a charging device 40 which attaches to a jack 42 in the second compartment 18.

The hinge 14 of the invention may be a ratcheting hinge which allows for a predetermined number, e.g., at least four, of different locking positions to direct the light source. The ratcheting hinge is unique in design specifically to offer the locking positions in order to direct the light at the appropriate places. Neodymium magnets are preferably used to keep the light closed and to prevent accidental "on time." The magnets snap shut when the light is closed.

The hook member 16, which may be retractable, is preferably located on the backside of the first compartment 12 of the light 10 and is used to hang the light 10, as well as offering a 360 degree swivel feature. However, the hook member 16 may be operatively positioned in any suitable position on the light 10. When the hook member 16 is in a closed position, the hook member 16 is in the recess portion 22 such that the hook member 16 is preferably flush with the backside of the housing 13 of the first compartment 12.

In a preferred embodiment, the light 10 includes a charging device 40, which is preferably a 120 volt "smart" charger that will not overcharge the battery pack when the battery pack is fully charged. However, any suitable charger may be used. A belt pouch or any other suitable device may be utilized for carrying and/or holding the pocket light 10.

The light 10 may be constructed of any suitable material including, but not limited to, plastics, metals, and/or a combination thereof.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A foldable light emitting diode (LED) light comprising:

a first housing;

a second housing which mates with said first housing when in a folded and closed position and has substantially common circumferential dimensions as said first housing;

a hinge assembly joining said first housing and said second housing, wherein said hinge assembly comprises a rotatable hinge;

a plurality of LED lights operatively positioned in an inner recess of said first housing and arranged in a plurality of rows and columns;

a power source in said first housing and/or said second housing, and a circuit between said power source and said plurality of LED lights;

an activating member in said first housing which opens and closes said circuit thereby turning on or off said plurality of LED lights, wherein said activating member comprises a moveable member extending at least from an inner surface of said first housing and structured in relation to said circuit and said first housing so that when said moveable member is pressed inward of said first housing said circuit is open and said plurality of LED lights are turned off, and when said moveable member is released said circuit is closed and said plurality of LED lights are turned on;

a hanger assembly on said first housing comprising a hook member attached to a bridge member wherein said bridge member has a first end held in relation to a first portion of said first housing and a second end held in relation to a second portion of said first housing, said hanger assembly being constructed and arranged to provide a 360 degree swivel to the foldable LED light;

wherein said first housing includes a recess portion for receiving said hanger member when not in use such that said hanger member is substantially flush with an exterior surface of said first housing; and wherein when the foldable LED light is in the folded and closed position, the plurality of LED lights are off and not exposed to an environment of use.

2. The foldable LED light of claim 1, wherein said power source includes nickel metal hydride AA batteries.

3. The foldable LED light of claim 1, wherein said rotatable hinge member is a ratcheting hinge having a predetermined number of releasably locked positions.

4. The foldable LED light of claim 1, further comprising at least a first magnet in said first housing and at least a second magnet in said second housing, said first magnet and said second magnet being constructed and arranged to aid in keeping said foldable LED light in a closed position and said plurality of LED lights turned off when said foldable LED light is not in the open position.

5. The foldable LED light of claim 1, further comprising a charging device constructed and arranged to charge said power source.

6. The foldable LED light of claim 1, wherein said first housing and said second housing are constructed of at least one of plastic, metal and/or a combination thereof.

7. The foldable LED light of claim 1, wherein said plurality of rows and columns of said plurality of LED lights comprises at least eighteen LED lights configured in six rows and three columns.

8. The foldable LED light of claim 1, wherein said first housing further includes means for grasping said hanger assembly when it is stored in said recess portion.

* * * * *